United States Patent [19]

Gasior et al.

[11] 3,970,434

[45] July 20, 1976

[54] PROCESS FOR REDUCING SULFUR IN COAL CHAR

[75] Inventors: Stanley J. Gasior, Pittsburgh; Albert J. Forney, Coraopolis; William P. Haynes, Pittsburgh; Richard F. Kenny, Venetia, all of Pa.

[73] Assignee: The United States of America as represented by the United States Energy Research and Development Administration, Washington, D.C.

[22] Filed: Oct. 7, 1974

[21] Appl. No.: 512,819

[52] U.S. Cl. ..... 44/1 F; 48/210; 201/17

[51] Int. Cl.[2] ..... C10L 9/10; C10J 3/00; C10B 57/00

[58] Field of Search ..... 44/1 R, 1 F, 1 G; 201/17; 75/6; 48/210

[56] References Cited

UNITED STATES PATENTS

| | | | |
|---|---|---|---|
| 3,463,623 | 8/1969 | Forney et al. | 201/31 X |
| 3,640,016 | 2/1972 | Lee et al. | 44/1 R |
| 3,756,791 | 9/1973 | Mancke | 44/1 R |

*Primary Examiner*—Carl F. Dees

[57] ABSTRACT

Coal is gasified in the presence of a small but effective amount of alkaline earth oxide, hydroxide or carbonate to yield a char fraction depleted in sulfur. Gases produced during the reaction are enriched in sulfur compounds and the alkaline earth compound remains in the char fraction as an alkaline earth oxide. The char is suitable for fuel use, as in a power plant, and during combustion of the char the alkaline earth oxide reacts with at least a portion of the sulfur oxides produced from the residual sulfur contained in the char to further lower the sulfur content of the combustion gases.

3 Claims, No Drawings

PROCESS FOR REDUCING SULFUR IN COAL CHAR

BACKGROUND OF THE INVENTION

Coal may be gasified by contacting it with steam and an oxygen containing gas at a temperature generally in the range of about 700° to 1100°C. Products of the gasification reaction include hydrogen, carbon monoxide, carbon dioxide, sulfur compounds such as hydrogen sulfide and carbonyl sulfide and hydrocarbons such as methane. Depending upon gasification conditions, the residue remaining from the gasification reaction may be either an ash or a char. An example of a gasification process which produces a dry ash residue is the Lurgi process while gasification techniques such as the Bureau of Mines-developed Synthane process produce a dry char residue. This char residue may be burned as a fuel in a power plant as a substitute for coal. Such char residues typically contain considerably less sulfur than was contained in the coal which was gasified. However, the coal chars produced during gasification from high sulfur coals retain levels of sulfur above 1.0% and, therefore, do not meet the Environmental Protection Agency's requirements for low sulfur fuels.

It is known to gasify coal in the presence of such materials as lime and dolomite. One example of such a technique is the so-called carbon dioxide acceptor process in which calcined dolomite and char are reacted with steam to produce a methane containing gas and a residue of dolomite and char. This residue of spent dolomite and unreacted char is then introduced into a second vessel where the unreacted carbon is burned with air and the heat produced calcines and regenerates the dolomite. This process is described in U.S. Pat. No. 3,115,394.

It is also known to remove sulfur oxides from flue gases produced by the combustion of coal by contacting those gases with limestone based materials. Finely divided limestone may be injected directly into a boiler furnace at a point somewhat removed from the flame, or particulate limestone or dolomite may be used as a fixed, moving, or fluidized bed to contact and absorb sulfur oxides contained in a flue gas stream. It is also known that combustion of sulfur-bearing coal or oil may be conducted in a fluidized bed of limestone which reacts with sulfur oxides produced during the combustion.

SUMMARY OF THE INVENTION

We have found that gasification of coal in admixture with a small amount of relatively finely divided alkaline earth metal oxides, hydroxides, or carbonates enhances the gas yield and decreases the sulfur content of the char residue. The alkaline earth compound remains with the char residue in the oxide form. During later combustion of the char residue, some of the remaining sulfur in the char is captured by the alkaline earth oxide, thus further reducing the sulfur oxide content of the combustion gases.

Hence, it is the object of our invention to reduce the sulfur content of a char residue produced by the gasification of coal.

Another object of our invention is to enhance the gas yield produced by the gasification of coal.

Another object of our invention is to allow utilization of high sulfur coals in the gasification reaction.

DETAILED DESCRIPTION OF THE INVENTION

Gasification of coal is an endothermic proces occurring within the temperature range of about 700° to 1100°C. While heat to drive the gasification reaction can be provided in a variety of ways, our process is restricted to those gasification techniques in which steam and oxygen are reacted with coal. Two major reactions occur in this process. Oxygen reacts with carbon contained in the coal to produce carbon monoxide as the principal product. This reaction is exothermic and provides the heat to drive the process. In the second reaction, steam reacts with carbon to form a mixture of carbon monoxide and hydrogen gases. This reaction is endothermic and is driven by the heat supplied by the first reaction. Products of the reaction include a gaseous fraction comprising carbon monoxide, hydrogen, carbon dioxide, some hydrocarbon gases such as methane, and sulfur compounds such as hydrogen sulfide and carbonyl sulfide. A by-product coal char residue having value as a fuel for boilers or power plants is also produced by this process.

We have found that the addition of minor amounts of an alkaline earth compound to the coal in steam-oxygen or steam-air gasification processes results in an increased conversion of the coal thus enhancing the gas yield and lowering the sulfur content in the by-product char residue. Alkaline earth compounds useful in our process include the oxides, hydroxides, and carbonates. Because of their availability and convenience, we prefer to use naturally occurring calcium and magnesium carbonates, such as limestone or dolomite, in our process.

In a preferred embodiment of our process, limestone or dolomite in a relatively finely divided form is mixed with coal and the mixture is gasified with steam and an oxygen containing gas. The ground limestone or dolomite may be mixed with the coal prior to introduction into the reaction vessel or it may be introduced separately into the gasification reactor. Amount of limestone or dolomite added may range from about 0.5 to 10% of the coal weight. However, we prefer to add from about 1 to 5% of alkaline earth compound based on the coal weight. The gasification reaction is preferably carried out at a temperature within the general range of about 800° to 1050°C.

The gasification reaction may be accomplished in apparatus similar to that described in U.S. Pat. No. 3,463,623. The apparatus described in that patent comprises a retort having an upper free-fall pretreating zone and a lower fluidized bed gasification zone. Other types of apparatus, such as that developed by the Bureau of Mines for use in the Synthane process are also appropriate. The Synthane process utilizes a two-stage pressurized gasifier in which the coking properties of the coal are destroyed by pretreatment with oxygen and steam either in a free-fall stage or in a fluid bed. The coal then enters a carbonization zone and is finally gasified in a lower zone using steam and oxygen. Char and ash are removed from the bottom of gasifier vessel and raw product gas is removed from the top. Similar types of apparatus, preferably of the fluidized bed type, may be used as well. Particle size of the coal feed is preferably that normally used in gasification reactions.

The following example setting out a series of experimental tests serves to illustrate the results obtained by practice of our invention.

EXAMPLE

A bituminous coal from the Illinois No. 6 seam, River King Mine, having an original sulpur content of 3.9% was gasified with steam and oxygen at a temperature of 900° to 1000°C and a pressure of 600 psig in a fluidized bed-type apparatus similar to that described in U.S. Pat. No. 3,463,623. The same coal was gasified utilizing essentially the same processing conditions but with the addition of 2% dolomite in one test and 5% dolomite in another test. By analysis, the dolomite consisted of about 55 weight percent calcium carbonate and 44 weight percent magnesium carbonate. The dolomite was ground to a size where 85% passed a 100 mesh U.S. standard sieve. Results of these tests are set out in Table 1.

TABLE 1

| | Test No. | Max. temp., °C | Coal feed rate, lb/hr | Carbon Conversion, % | Sulfur in coal-char residue, wt. % |
|---|---|---|---|---|---|
| Without dolomite | 27 | 970 | 21.2 | 59 | 1.1 |
| With 2% dolomite | 34 | 965 | 20.6 | 83 | 0.7 |
| With 5% dolomite | 28 | 995 | 20.9 | 61 | 0.6 |

An analysis was made of coal used in these gasification experiments and the char residue from each test was analyzed as well. These analyses are set out in Table 2.

TABLE 2

| | Coal % | Char Test 27 % | Char Test 34 % | Char Test 28 % |
|---|---|---|---|---|
| Moisture | 5.8 | 1.2 | 1.8 | 1.4 |
| Volatile matter | 40.7 | 3.3 | 3.8 | 2.5 |
| Fixed cabon | 44.8 | 65.6 | 53.4 | 65.7 |
| Ash | 8.7 | 29.9 | 41.0 | 30.4 |
| Hydrogen | 5.3 | 1.0 | 1.0 | 0.9 |
| Carbon | 66.7 | 66.5 | 54.7 | 65.7 |
| Nitrogen | 1.2 | 0.5 | 0.3 | 0.4 |
| Oxygen | 14.2 | 1.0 | 2.3 | 2.0 |
| Sulfur | 3.9 | 1.1 | 0.7 | 0.6 |

As can be seen from the data, addition of dolomite to the gasification reaction substantially decreased the sulfur content of the char residue. The additional sulfur extracted from the char reported to the gas fraction. The gas product from test 28, carried out with 5% dolomite addition, contained approximately 0.1% more sulfur than did the gas produced from test 27 which was run without dolomite. As also may be seen from the data presented in Table 1, dolomite addition enhanced the carbon conversion in the reaction. This effect is more pronounced at the lower concentrations of dolomite additions. The dolomite residue in tests 28 and 34 remained with the char in the calcined or oxide form. Upon subsequent burning of char, the calcined dolomite residue acts to capture additional quantities of sulfur dioxide produced from the residual sulfur contained in the char.

Additional tests were performed using essentially the same conditions but substituting limestone and calcium hydroxide for the dolomite. Results obtained were essentially equivalent to those obtained using dolomite.

We claim:

1. A method of reducing sulfur emission in the combustion of coal char produced during gasification of coal and of enhancing carbon gasification conversion comprising mixing coal particles and particles of an additive in a proportion of 1 to 5 weight percent respecting said coal, said additive being selected from the group consisting of alkaline earth oxides, hydroxides, carbonates and mixtures thereof, and reacting said coal particles with steam and oxygen at a temperature of 800° to 1,050°C. at a pressure of about 600 psig within a fluidized bed of said coal particles and said additive particles to produce said coal char having an alkaline earth oxide in mixture therewith and product gas including carbon monoxide, carbon dioxide, hydrogen, hydrocarbon gases and gaseous sulfur compounds, said coal char with said alkaline earth oxide having reduced sulfur content in respect to that of said coal; and burning said coal char in mixture with said alkaline earth oxide whereby gaseous sulfur oxide emissions are at least partially captured.

2. The method of claim 1 wherein said additive is dolomite.

3. The method of claim 1 wherein said additive is lime-stone.

* * * * *